US006629571B1

(12) United States Patent
Downie

(10) Patent No.: US 6,629,571 B1
(45) Date of Patent: Oct. 7, 2003

(54) DOWNHOLE MOTOR ASSEMBLY

(75) Inventor: Andrew Downie, Fife (GB)

(73) Assignee: Neyrfor-Weir Limited, Aberdeen (GB)

( * ) Notice: Subject to any disclaimer, the term of this patent is extended or adjusted under 35 U.S.C. 154(b) by 0 days.

(21) Appl. No.: 09/601,096

(22) PCT Filed: Jan. 20, 1999

(86) PCT No.: PCT/GB99/00196

§ 371 (c)(1),
(2), (4) Date: Sep. 13, 2000

(87) PCT Pub. No.: WO99/39074

PCT Pub. Date: Aug. 5, 1999

(30) Foreign Application Priority Data

Jan. 28, 1998 (GB) ..... 9801644

(51) Int. Cl.[7] ..... E21B 7/08
(52) U.S. Cl. ..... 175/61; 175/73; 175/107
(58) Field of Search ..... 175/61, 73, 75, 175/76, 107

(56) References Cited

U.S. PATENT DOCUMENTS

| | | | | |
|---|---|---|---|---|
| 4,007,797 A | * | 2/1977 | Jeter | 175/26 |
| 4,739,842 A | | 4/1988 | Kruger et al. | |
| 4,895,214 A | | 1/1990 | Schoeffler | |
| 5,215,151 A | | 6/1993 | Smith et al. | |
| 5,368,398 A | | 11/1994 | Damm et al. | |
| 5,467,832 A | * | 11/1995 | Orban et al. | 175/45 |
| 5,857,531 A | * | 1/1999 | Estep et al. | 175/75 |
| 6,047,784 A | * | 4/2000 | Dorel | 175/61 |
| 6,109,370 A | * | 8/2000 | Gray | 175/61 |

FOREIGN PATENT DOCUMENTS

| | | |
|---|---|---|
| EP | 0 774 563 A2 | 11/1995 |
| GB | 2 307 537 A | 5/1997 |
| WO | WO 96/30616 A1 | 10/1996 |

* cited by examiner

*Primary Examiner*—William Neuder
(74) *Attorney, Agent, or Firm*—Alston & Bird LLP

(57) ABSTRACT

There is disclosed an improved downhole steerable motor assembly (5) and related method. A problem in known assemblies is that the distance from a bent housing bend axis to the face of a drill bit needs to be kept relatively short resulting in the length of the bearing package and its thrust capacity being restricted. Accordingly, the invention provides a downhole motor assembly (5) comprising a motor (115), at least one thrust bearing (116) and a bent portion (117), the assembly (5) having a first end (135) and a second end (140), the first end (135) being closer to surface than the second end (140), in use, wherein the bent portion (117) is closer to the second end (140) than is the at least one thrust bearing (116).

29 Claims, 5 Drawing Sheets

DOWNHOLE MOTOR ASSEMBLY

This invention relates to directional drilling, and in particular, though not exclusively, to such drilling in the oil and/or gas industries. The invention further relates to an improved downhole steerable motor assembly and related method.

Figure 1:
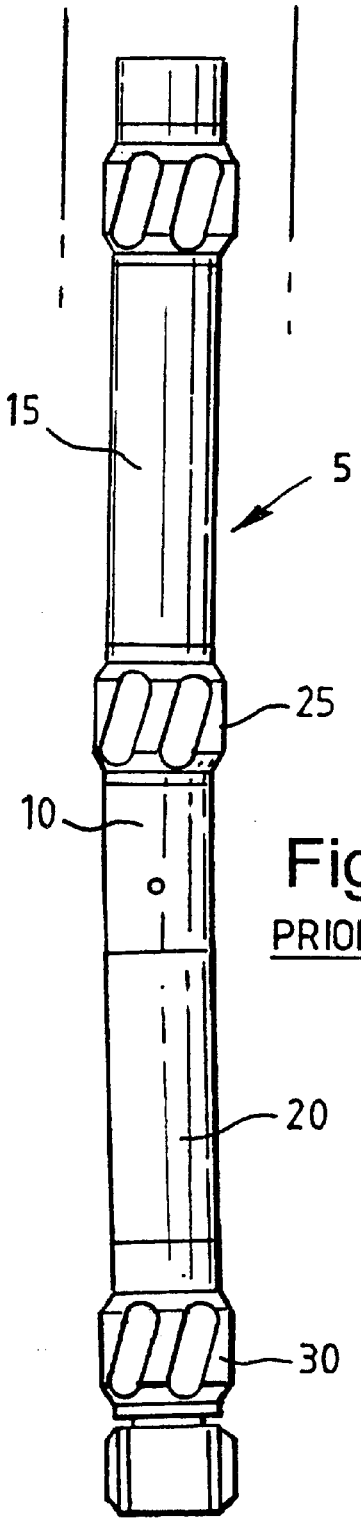
Fig. 1 PRIOR ART

In the drilling of deviated well bores in the oil and gas industry it is common practice to use downhole motors which incorporate a bend in the motor body to facilitate controlled deviation of the drilling assembly. Referring to FIG. 1 there is illustrated a prior art downhole motor, generally designated 5. As can be seen from FIG. 1, the motor 5 comprises a motor body comprising a bent housing 10, a motor power/drive section 15, and a thrust bearing package 20, the bent housing being fitted between the motor power/drive section 15 and the thrust bearing package 20. The bent housing motor 5 when used in conjunction with a suitable measurement and telemetry system allows a well bore to be deviated in a controlled manner using the so-called slide/rotate method. In the rotate mode a drill string (not shown) to which the bent housing 10 and motor section 15 are attached, is rotated during drilling and consequently the bend in the tool has no specific direction. The drilling process is effected by the motor 5 driving a drill bit (not shown), the direction of progress is nominally straight ahead although minor build or drop tendencies can be induced by appropriate selection of the sizes and placement of body stabilisers 25, 30. In the slide mode the motor body is not rotated, the bend in the body is aligned to face in a desired direction. Drilling is achieved using the motor 5 to drive the drill bit and the body is held in a nominal direction to cause the wellbore to deviate in a controlled manner.

Conventionally downhole motors are fitted with a thrust bearing package 20 to absorb hydraulic loading from the motor 5 and mechanical loads imposed during the drilling operation. Due to the limited diameter available in downhole equipment it is usually necessary to have a number of thrust stages to absorb these loads. Consequently, a finite axial length is required to house these thrust stages.

The most common type of motor used in the directional drilling industry is the Moineau type or a positive displacement motor (PDM) which has a universal coupling between the motor power section 15 and the thrust bearing package 20. This is necessary to allow the eccentric motion of a rotor to be converted into a co-axial rotation of a drill bit drive shaft. A universal joint is required to transmit power through the misalignment induced between the rotor and drill bit drive shaft, by the bend in the body. Therefore, it has become common practice to position the bend between the motor drive section 15 and the thrust bearing section 20.

The distance from the bent housing 10 bend axis to the face of the drill bit needs to be kept relatively short and this results in the length of bearing package and its thrust capacity (number of thrust stages) being restricted.

It is an object of the present invention to obviate or mitigate one or more of the aforementioned problems in the prior art.

According to a first aspect of the present invention there is provided a downhole motor assembly comprising a motor, at least one thrust bearing, and a bent portion, the assembly having a first end and a second end, the first end being closer to surface than the second end, in use, wherein the bent portion is closer to the second end than is the at least one thrust bearing.

The downhole motor assembly may also provide at least one further thrust bearing, wherein the at least one further thrust bearing is closer to the second end than is the bent portion.

In a preferred embodiment the at least one thrust bearing may be provided between the motor and the bent portion.

An at least one yet further thrust bearing may be provided, wherein the at least one further thrust bearing is closer to the first end than is the motor.

In an alternative embodiment the motor may be provided between the at least one thrust bearing and the bent portion.

In said alternative embodiment part of the motor may be provided closer to the second end than is the bent portion.

The motor may be provided within a motor drive section.

The at least one thrust bearing may be provided within a thrust bearing section.

The bent portion may comprise a bent housing.

Herein the term "motor" is to be understood to mean at least one motor and may comprise a plurality of individual motors.

The motor may be of a hydraulic type.

The motor may be of a turbine type.

The motor may comprise a Moineau motor, PDM motor, or an electric motor.

The at least one thrust bearing may comprise at least one elastomer bearing.

The at least one thrust bearing may additionally or alternatively comprise at least one metal bearing.

A plurality of elastomer and/or metal bearings may be provided, the type and number being selected accorded to a required preselected thrust capacity.

The thrust bearing section may include a driveshaft.

The driveshaft may be flexible.

The driveshaft may thus be made from a resiliently flexible material. For example, the driveshaft may be made at least partially from titanium or copper beryllium steel.

Alternatively, the driveshaft may include one or more (and preferably at least two) swivel/universal joints.

The bent housing may include a driveshaft flexible coupling.

The second end may include an output shaft operably connected to the driveshaft.

The second end may further provide a bit connection means.

The motor assembly may provide at least one stabiliser on an outermost surface thereof.

The motor assembly may provide a first stabiliser at an end of the motor closer to the at least one thrust bearing than another end of the motor.

The motor assembly may provide a second stabiliser at or near the second end of the assembly.

The motor and the at least one thrust bearing may be coupled by a flexible coupling.

Where the motor comprises a plurality of individual motors one or more individual motors may be coupled one to the other by a further flexible coupling.

According to a second aspect of the present invention there is provided a method of directional drilling of a wellbore comprising:

providing a downhole motor assembly, the assembly comprising a motor, at least one thrust bearing and a bent portion, the assembly having a first end and a second end, the first end being closer to surface than the second end, in use, wherein the bent portion is closer to the second end than is the at least one thrust bearing;

directionally drilling the well bore by means of the assembly.

Figure 2:
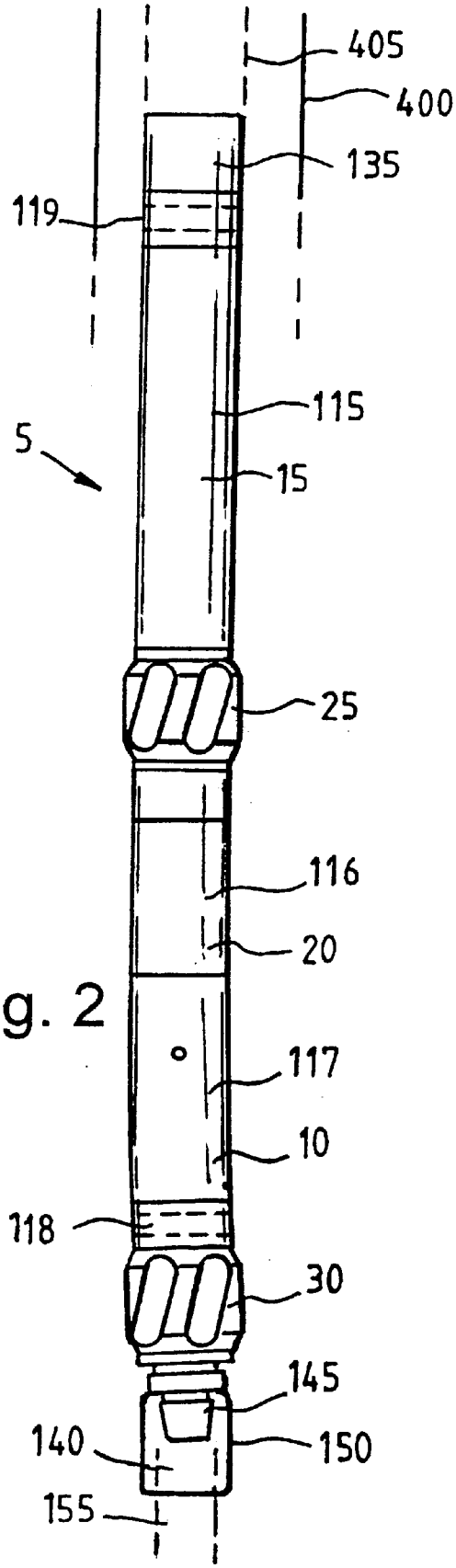

An embodiment of the present invention will now be described, by way of example only, with reference to the accompanying drawings, which are:

FIG. 1 a schematic side view of a downhole steerable motor assembly according to the prior art;

FIG. 2 a schematic side view of a downhole steerable motor assembly according to an embodiment of the present invention;

FIGS. 3 (A)–(B) a series of sectional side views of a motor drive section for use in the motor assembly of FIG. 2, and FIGS. 4 (A)–(B) a series of sectional side views of a thrust bearing section and bent housing for use in the motor assembly of FIG. 2.

Referring initially to FIG. 2 there is shown a downhole motor assembly, generally designated 5, according to an embodiment of the present invention.

The downhole motor assembly 5 comprises a motor 115, at least one thrust bearing 116 and a bent portion 117, the assembly having a first end 135 and a second end 140, the first end 135 being closer to surface than the second end 140, in use, and wherein further the bent portion 117 is closer to the second end 140 than is the at least one thrust bearing 116.

In a modified embodiment the downhole motor assembly 105 may also provide at least one further thrust bearing 118, wherein the at least one further thrust bearing 118 is closer to the second end 140 than is the bent portion 117.

In the illustrated embodiment the at least one thrust bearing 116 is-provided between the motor 115 and the bent portion 117.

In a further modified embodiment an at least one yet further thrust bearing 119 may be provided, wherein the at least one further thrust bearing 119 is closer to the first end 135 than is the motor 115.

In a yet further modified embodiment the motor 115 may be provided between the at least one thrust bearing 116 and the bent portion 117. In said yet further modified embodiment part of the motor 115 may be provided closer to the second end 140 than is the bent portion 117.

The motor 115 is provided within a motor drive section 15, while the at least one thrust bearing 116 is provided within a thrust bearing section 20. Further, the bent portion 117 comprises a bent housing 10.

In this embodiment the motor 115 is a hydraulic type, and may be of a turbine type, such as a Moineau motor or a PDM motor. It will however be appreciated that the motor may comprise an electric motor.

As will hereinafter be described in greater depth the at least one thrust bearing 116 comprises a plurality of elastomer and/or metal bearings, the type and number being selected according to a required preselected thrust capacity. The thrust bearing section 20 includes a driveshaft (not shown in FIG. 2) with a spline and taper coupling at one end for connection to the motor 115. The bent housing 10 includes a flexible driveshaft (not shown in FIG. 2) which is flexible and made, for example, at least partially from titanium or copper beryllium, the flexible driveshaft being connected at one end to a thrust bearing driveshaft and at its other end to an output shaft 145.

Thus, the second end 140 includes the output shaft 145 operably connected to the driveshaft. The second end 140 further provides a bit connection means 150 to facilitate connection of the assembly 5 to a bit 155.

The motor assembly 105 provides at least one stabiliser on an outermost surface thereof. In this embodiment the motor assembly 105 provides a first stabiliser 25 at an end of the motor 115 close to the at least one thrust bearing 116 than another end of the motor 115. The motor assembly 105 further provides a second stabiliser 30 at or near the second end 140 of the assembly 5.

Figure 3A:
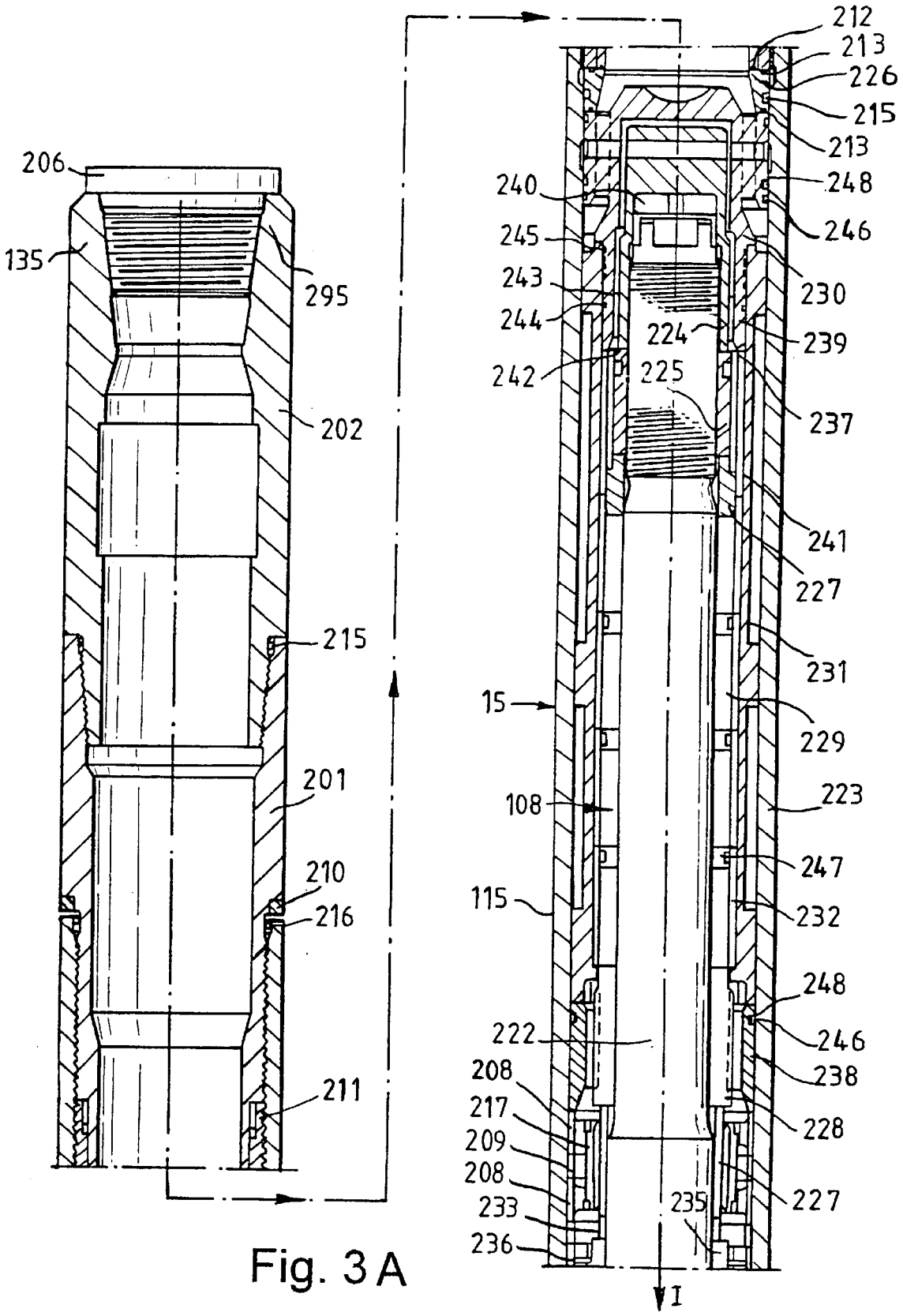
Figure 3B:
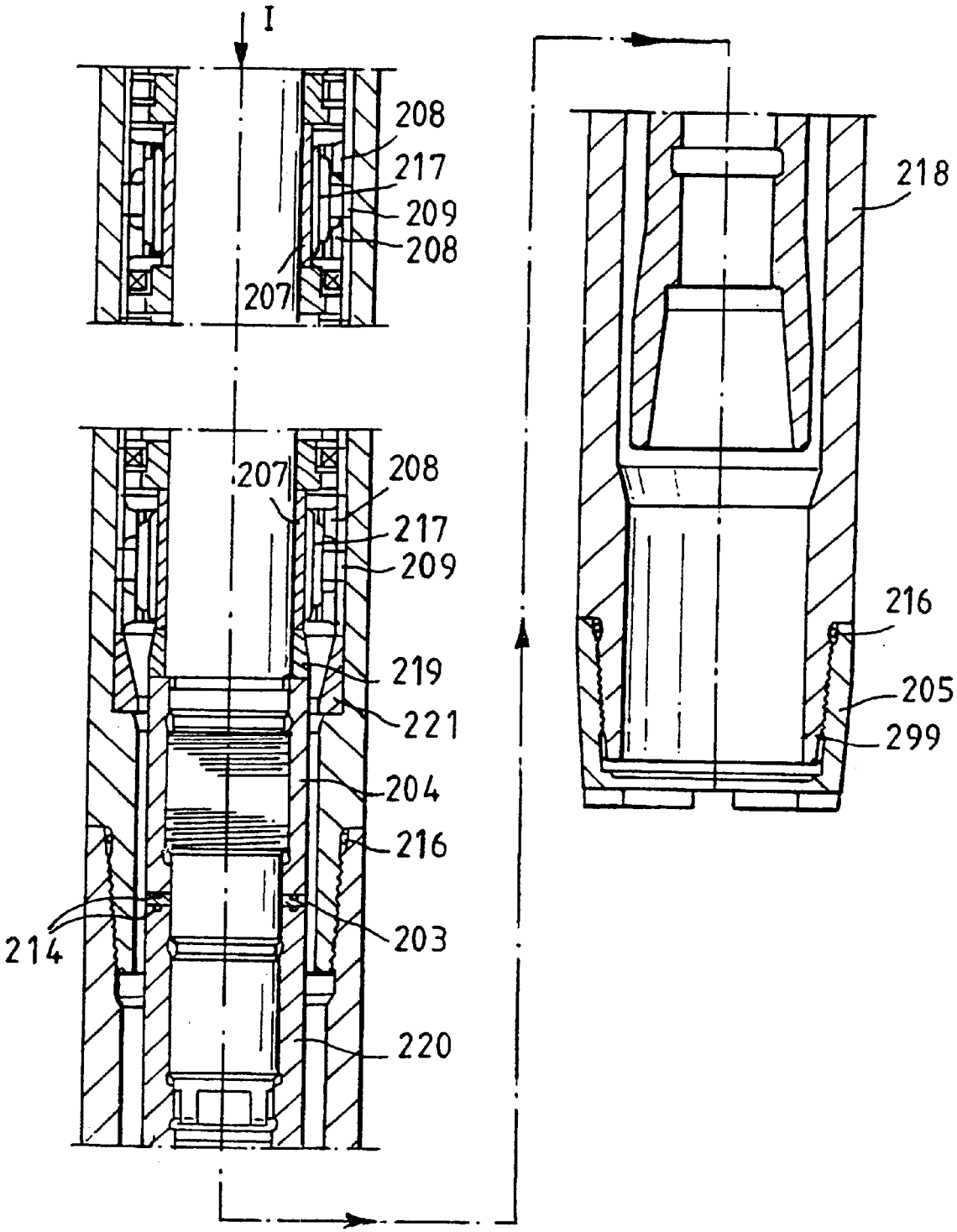

Referring now to FIGS. 3(A) and 3(B), there is shown a motor drive section 15 including a motor 115 for use in the motor assembly 5 of the present invention, the motor 115 being of a turbine type.

The motor 115 comprises: male protector 206, female connector 295, top sub 202, low ring 215, body top sleeve 201, filler ring 210, O-ring 216, stator assembly nut 211, O-ring 212, O-ring 213, body compression sleeve 226, O-ring 215, O-ring 213, back-up ring (PTFE solid type) 248, O-ring 246, balance drum end cap 230, bush 239, cap nut 224, adjusting spacer balance bush 237, shaft nut 225, spacer 241, shaft compression sleeve 227, balance housing 231, balance drum 229, body 108 stage 223, erosion plate 247, balance bushes 232, further back-up ring (PTFE solid type) 248, further O-ring 246, stator locking bush 238, shaft 108 stage 222, rotor locking bush 228, bearing wear sleeve 227, body spacer 234, rotor 235, spacer, shaft end cap 240, O-ring 245, O-ring 243, O-ring 244, O-ring 242, bearing support disc 228, bearing rubber 217, cylindrical thrust spacer 209, further support disc 208, shaft spacer 233, stator 236. In this embodiment there are some 95 turbine stages comprising a rotor 235 and stator 236. Radial guide bearings comprising, a bearing support disc 208, bearing rubber 217, cylindrical thrust space 209 and further support disc 209 and wear sleeve 207, are provided at intervals to support the turbine rotor 235 and shaft 222 assembly. The motor 115 further comprises rotor assembly spacer 219, thrust sleeve 221, thrust nut 204, O-ring 206, couple spacer 203, female shaft coupling 220, plain nipple 218, further O-ring 216, female protector for pin 205, and O-rings 214.

Figure 4A:
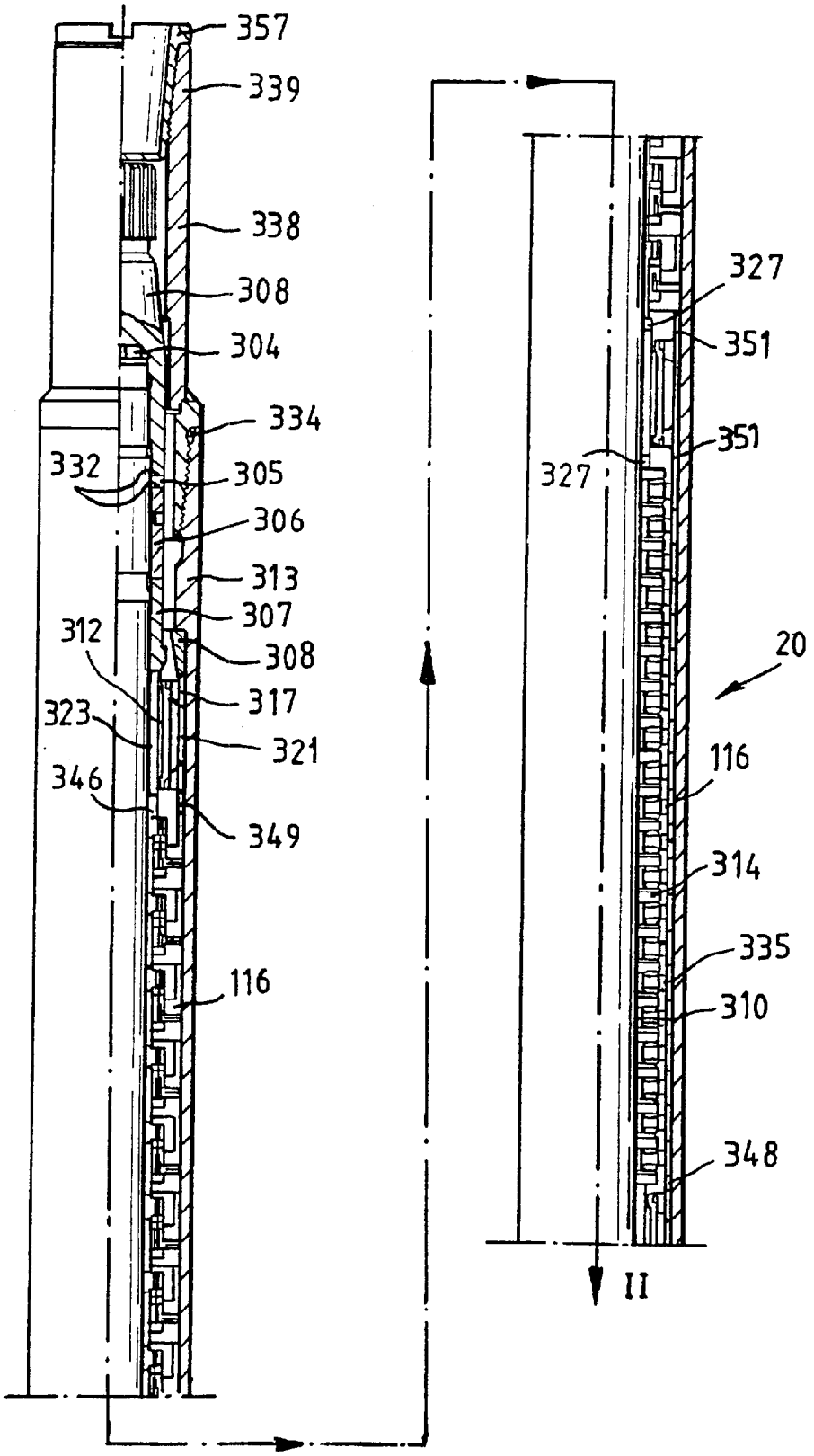
Figure 4B:
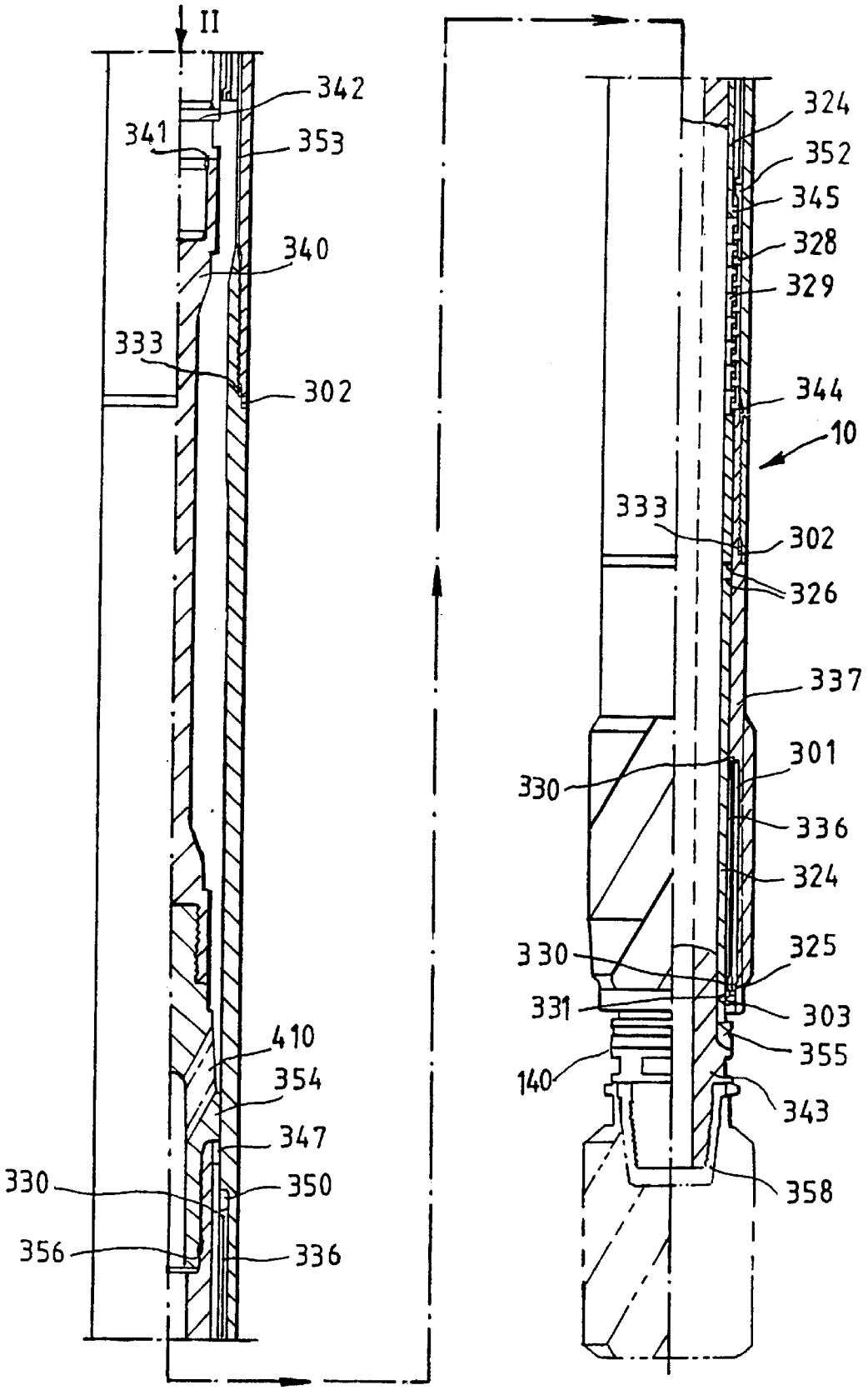

Referring now to FIGS. 4(A) and 4(B), there is shown a thrust bearing section 20 and a bent housing 10 for use in the motor assembly 5 of the present invention. The thrust bearing section 20 includes a plurality of thrust bearings 116, while the bent housing 10 includes a driveshaft flexible coupling.

The thrust bearing section 20 comprises: shipping protector 357, male coupling protector 338, male shaft coupling 309, thrust washer 304, O-ring 334, O-rings 332, coupling spacer 305, rotor assembly nut 306, body 313, shaft compression sleeve 307, thrust sleeve 308, intermediate bearing support disc 317, cylindrical thrust spacer 321, removable intermediate bearing 312, intermediate bearing wear sleeve 323, cylindrical thrust spacer 349, thrust bearing spacer 346, lantern ring spacer 327, cylindrical thrust spacer 351, further cylindrical thrust spacer 351, further lantern ring spacer 327, cylindrical thrust spacer 348. Between the thrust bearing spacer 346, and the lantern ring spacer 327 there are provided a plurality of hydraulic metal bearing stages. In this embodiment there are provided ten such stages. Further between the further lantern ring spacer 327, and the cylindrical thrust spacer 348 there are provided a plurality of elastomer bearing stages. In this embodiment there are provided twenty such elastomer bearings.

The structure and functioning of the metal bearing stages and the elastomer bearing stages will be apparent to those skilled in the art.

Each elastomer bearing stage includes a moving disc 314, fixed disc 335, and thrust bearing spacer 310.

The thrust bearing section 20 further comprises upper shaft 342, cylindrical thrust spacer 353, filler ring 302, O-ring 341, and O-ring 333.

The bent housing 10 includes flexible shaft 340, an end of which protrudes into an adjacent end of the thrust bearing section 20. The bent housing 10 further includes coupling flow despatcher 354, spacer flow despatcher 347, cylindrical thrust spacer 350, O-ring 330, O-ring 356, removable bearing shelf 336, bottom bearing wear sleeve 324, cylindrical thrust spacer 352, rotor compression spacer 345, labyrinth stator 328, labyrinth rotor 329, bent body 344, filler ring 302, further O-ring 333, bottom bearing spacer 326, bottom bearing stabiliser 337, removable bearing key 301, removable bearing shell 336, bottom bearing wear sleeve 324, bearing shell/spacer 325, bearing shell circlip 333, shaft wear ring 355, lower shaft 343, shipping protector 358, O-ring 330, further O-ring 330, and O-ring 331.

In use the assembly 5 is lowered down a borehole 400 on a drill string 405 to a desired location. Hydraulic fluid is supplied to the motor 115 causing rotation of rotor 235. Upper shaft 342 is coupled to the rotor 335, the flexible shaft 340 being coupled to the upper shaft 342, the lower shaft 343 being coupled to the flexible shaft 340. In this way rotation of the rotor 334 causes rotation of the upper shaft 342, flexible shaft 340, and lower shaft 343. Thus drill bit 155 is controllably rotated. The fluid passes down inside the drillstring 405, down an annular space in the motor 115, down a further annular space in the thrust bearing section 20, down a yet further annular space in the bent housing 10 through ports 410, down lower shaft 343 through apertures in the bit 155, passing back-up via annular space between the wellbore 400 and the drillstring 405.

To allow assembly of the motor drive section 15 with the thrust bearing 20, and bent housing 10, the male protector 206, female protector 305, shipping protector 357, and shipping protector 358 are removed, and an end 299 of the motor drive section 15 coupled with an end 399 of the thrust bearing section 20.

It will be appreciated that the embodiment of the invention hereinbefore described is given by way of example only, and is not meant to limit the scope of the invention in any way. For example, it will be appreciated that although the disclosed embodiment illustrates a shaft made from a resiliently flexible material, the shaft may alternatively be made from two or more shaft sections joined by swivel/universal joints.

What is claimed is:

1. A downhole motor assembly comprising a motor, at least one thrust bearing, and a bent portion, the assembly having a first end and a second end, the first end being closer to the surface than the second end, in use, wherein the bent portion is closer to the second end than is the at least one thrust bearing, and wherein the at least one thrust bearing bears between a body of the motor and an output shaft of the assembly.

2. A downhole motor assembly as claimed in claim 1, wherein there is provided at least one further thrust bearing, the at least one further thrust bearing being closer to the second end than is the bent portion.

3. A downhole motor assembly as claimed in claim 1, wherein the at least one thrust bearing is provided between the motor and the bent portions.

4. A downhole motor assembly as claimed in claim 1, wherein an at least one yet further thrust bearing is provided, wherein the at least one yet further thrust bearing is closer to the first end than is the motor.

5. A downhole motor assembly as claimed in claim 1, wherein the motor is provided between the at least one thrust bearing and the bent portion.

6. A downhole motor assembly as claimed in claim 5, wherein the motor is provided closer to the second end than is the bent portion.

7. A downhole motor assembly as claimed in claim 1, wherein the motor is provided within a motor drive section.

8. A downhole motor assembly as claimed in claim 1, wherein the at least one thrust bearing is provided within a thrust bearing section.

9. A downhole motor assembly as claimed in claim 1, wherein the bent portion comprises a bent housing.

10. A downhole motor assembly as claimed in claim 1, wherein the motor comprises one or more individual motors.

11. A downhole motor assembly as claimed in claim 1, wherein the motor is a hydraulic type.

12. A downhole motor assembly as claimed in claim 1, wherein the motor is of a turbine type.

13. A downhole motor assembly as claimed in claim 1, wherein the motor comprises a Moineau motor, PDM motor, or an electric motor.

14. A downhole motor assembly as claimed in claim 1, wherein the at least one thrust bearing comprises at least one elastomer bearing and/or at least one metal bearing.

15. A downhole motor assembly as claimed in claim 14, wherein a plurality of elastomer and/or metal bearings are provided, the type and number being selected according to a required preselected thrust capacity.

16. A downhole motor assembly as claimed in claim 8, wherein the thrust bearing section includes a driveshaft.

17. A downhole motor assembly as claimed in claim 16, wherein the driveshaft is flexible.

18. A downhole motor assembly as claimed in claim 17, wherein the driveshaft is made at least partially from, titanium or copper beryllium steel.

19. A downhole motor assembly as claimed in claim 9, wherein the bent housing includes a driveshaft flexible coupling.

20. A downhole motor assembly as claimed in claim 16, wherein the second end includes an output shaft operably connected to the driveshaft.

21. A downhole motor assembly as claimed in claim 1, wherein the second end provides a bit connection means.

22. A downhole motor assembly as claimed in claim 1, wherein the motor assembly provides at least one stabiliser on an outermost surface thereof.

23. A downhole motor assembly as claimed in claim 1, wherein the motor assembly provides a first stabiliser at an end of the motor closer to the at least one thrust bearing than another end of the motor.

24. A downhole motor assembly as claimed in claim 23, wherein the motor assembly provides a second stabiliser at or near the second end of the assembly.

25. A downhole motor assembly as claimed in claim 1, wherein the motor and the at least one thrust bearing are coupled by a flexible coupling.

26. A downhole motor assembly as claimed in claim 10, wherein where the motor comprises a plurality of individual motors one or more individual motors are coupled one to the other by a further flexible coupling.

27. A method of directional drilling of a wellbore comprising:

providing a downhole motor assembly, the assembly comprising a motor, at least one thrust bearing and a bent portion, the assembly having a first end and a second end, the first end being closer to the surface than the second end, in use, wherein the bent portion is closer to the second end than is the at least one thrust bearing, and wherein the at least one thrust bearing bears between a body of the motor and an output shaft of the assembly;

directionally drilling the well bore by means of the assembly.

28. A downhole motor assembly comprising a motor, at least one thrust bearing, and a fixed bent housing, the assembly having a first end and a second end, the first end being closer to the surface than the second end, in use, wherein the fixed bent housing is closer to the second end than is the at least one thrust bearing, and wherein the at least one thrust bearing bears between a body of the motor and an output shaft of the assembly.

29. A method of directional drilling of a wellbore comprising:

providing a downhole motor assembly, the assembly comprising a motor, at least one thrust bearing and a fixed bent housing, the assembly having a first end and a second end, the first end being closer to surface than the second end, in use, wherein the fixed bent housing is closer to the second end than is the at least one thrust bearing, and wherein the at least one thrust bearing bears between a body of the motor and an output shaft of the assembly; and directionally drilling the well bore by means of the assembly.

* * * * *